US006923699B2

(12) United States Patent
Matsubara et al.

(10) Patent No.: US 6,923,699 B2
(45) Date of Patent: Aug. 2, 2005

(54) METHOD OF MAKING A SPARK PLUG

(75) Inventors: Yoshihiro Matsubara, Mie (JP); Shinichi Hiramatsu, Aichi (JP); Masahiro Ishikawa, Aichi (JP); Kazumi Kawamura, Mie (JP)

(73) Assignee: NGK Spark Plug Co., Ltd., Aichi (JP)

( * ) Notice: Subject to any disclaimer, the term of this patent is extended or adjusted under 35 U.S.C. 154(b) by 150 days.

(21) Appl. No.: 10/372,830

(22) Filed: Feb. 26, 2003

(65) Prior Publication Data

US 2003/0181121 A1 Sep. 25, 2003

(30) Foreign Application Priority Data

Feb. 27, 2002 (JP) ..... 2002-051291

(51) Int. Cl.[7] ..... H01T 21/02; H01T 12/20

(52) U.S. Cl. ..... 445/7; 313/141; 29/33 N; 29/33 M; 123/169 EL

(58) Field of Search ..... 445/7; 313/141; 29/33 N, 33 M; 123/169 EL

(56) References Cited

U.S. PATENT DOCUMENTS

| | | | | | |
|---|---|---|---|---|---|
| 2,377,481 | A | * | 6/1945 | Christie | 445/7 |
| 4,771,210 | A | * | 9/1988 | Mohle et al. | 313/141 |
| 6,215,235 | B1 | * | 4/2001 | Osamura | 313/141 |
| 6,346,766 | B1 | * | 2/2002 | Kanao et al. | 313/141 |
| 6,621,198 | B2 | * | 9/2003 | Kanao et al. | 313/141 |
| 2001/0030495 | A1 | * | 10/2001 | Kano et al. | 313/141 |
| 2002/0081932 | A1 | * | 6/2002 | Hanai | 445/7 |

FOREIGN PATENT DOCUMENTS

| | | | | |
|---|---|---|---|---|
| JP | 57-55083 | | 4/1982 | |
| JP | 59-40482 | | 3/1984 | |
| JP | 59-98489 | | 6/1984 | |
| JP | 60-262374 | | 12/1985 | |
| JP | 2-207477 | | 8/1990 | |
| JP | 4-366580 | | 12/1992 | |
| JP | 2000-277231 | A | 10/2000 | |
| JP | 2002-175864 | * | 6/2002 | 445/7 |

* cited by examiner

*Primary Examiner*—Joseph Williams
*Assistant Examiner*—Elizabeth Rielley
(74) *Attorney, Agent, or Firm*—Sughrue Mion, PLLC

(57) ABSTRACT

A method of making a spark plug having a noble metal chip joined to an electrode main body of a ground electrode by interposing therebetween an intermediate member. The method comprises the steps of prior to joining the noble metal chip to the electrode main body, joining the intermediate member and the noble metal chip together, placing a noble metal chip and intermediate member assembly on the electrode main body in a way as to allow the intermediate member to contact the electrode main body, and welding the electrode main body and the intermediate member together while restricting relative movement of the electrode main body and the intermediate member without applying an urging force to a joint between the intermediate member and the noble metal chip.

18 Claims, 10 Drawing Sheets

STEP 1

STEP 2

STEP 3

STEP 4

STEP 5

STEP 1

STEP 2

STEP 3

STEP 4

METHOD OF MAKING A SPARK PLUG

BACKGROUND OF THE INVENTION

The present invention relates to a method of making a spark plug.

A number of spark plugs of the kind in which a noble metal tip made of a metal containing Pt, Ir or the like as a major component is welded to an end of an electrode in order to improve the resistance to spark consumption have heretofore been proposed. Since a center electrode side whose polarity is frequently set negative at the time of spark discharge is subjected to strong attack of spark and liable to be consumed, a noble metal chip can produce a striking effect when used in the center electrode. However, as application of such spark plugs to high-output engines or lean-bum engines increases, a noble metal chip is employed increasingly also in the ground electrode side so as to meet the requirement that the ground electrode side has a high resistance to spark consumption. Heretofore, the noble metal chip on the ground electrode side is made of a Pt system alloy and welded to a main body of the ground electrode made of a Ni alloy or the like.

SUMMARY OF THE INVENTION

In joining of the noble metal chip and the electrode main body, the noble metal chip is first placed on the electrode main body. The metal chip and the electrode main body are then sandwiched between energizing electrodes and heated while being compressed by supplying current to the energizing electrodes. However, by this method, an excessively large compressive force is applied to the joining surfaces of the noble metal chip and the electrode main body at the time of welding, so that a defect such as cracks is liable to remain in the joining interface between the noble metal chip and the electrode main body after welding, thus possibly causing a problem that the noble metal chip and the electrode main body are easily separated from each other when subjected to cyclic heating and cooling.

In order that the spark consumption of the ground electrode side is suppressed more efficiently, it is being examined in these days that the material of the noble metal chip is changed from a Pt system alloy having been heretofore used mainly to an Ir system alloy having a higher heat resistance. However, since the noble metal chip made of an Ir system alloy has a high melting point, a defective joining interface is liable to be caused between the noble metal chip and the electrode main body due to insufficient melting, etc. when joined by resistance welding, thus causing a problem that the above-described cracks or separation is liable to occur. Further, other than the insufficient melting, a large difference in the coefficient of linear expansion between the Ir system alloy constituting the noble metal chip and the Ni system alloy constituting the ground electrode main body is a cause of the cracks and separation.

In order to mitigate the defect caused by the difference of the coefficient of linear expansion, it has been proposed to interpose between the noble metal chip and the electrode main body an intermediate member having a coefficient of linear expansion that is intermediate between those of the noble metal chip and the electrode main body. However, if the noble metal chip and the electrode main body are welded by resistance welding with the intermediate member being interposed therebetween and by applying thereto a high compressive force, cracks or separation is liable to be caused at the joining portions of the intermediate member and the noble metal chip when the intermediate member cuts largely into the electrode main body together with the noble metal chip, thus being incapable of solving the above problem satisfactorily.

It is accordingly an object of the present invention to provide a method of making a spark plug which his resistant to defects such as cracks or separation at the joining surfaces of a noble metal chip and a ground electrode main body at the time of welding of the noble metal chip to the electrode main body of the ground electrode.

To accomplish the above object, the present invention provides a method of making a spark plug that includes a ground electrode having an electrode main body and a noble metal chip joined to the electrode main body by interposing therebetween an intermediate member, the noble metal chip being disposed so as face a center electrode and define therebetween a spark discharge gap, the method comprising the steps of prior to joining the noble metal chip to the electrode main body, joining the intermediate member and the noble metal chip together and thereby forming a noble metal chip and intermediate member assembly, placing the noble metal chip and intermediate member assembly on the electrode main body in a way as to allow the intermediate member to contact the electrode main body, and welding the electrode main body and the intermediate member of the noble metal chip and intermediate member assembly together while restricting relative movement of the electrode main body and the intermediate member of the noble metal chip and intermediate member assembly without applying an urging force to a joint between the intermediate member and the noble metal chip by using an another member.

In the method of the present invention, once the noble metal chip is joined to the intermediate member, the intermediate member of the noble metal chip and intermediate member assembly is brought into contact with the electrode main body. The electrode main body and the intermediate member are welded together while restricting relative movement thereof without applying to the electrode main body and the intermediate member an urging force for urging the same against each other by using an another member. Since the intermediate member and the noble metal chip are welded without being subjected to such an excessively large force as in the prior art resistance welding, it becomes possible to protect the spark plug assuredly from the defect of cracks or separation being caused at the joint between the intermediate member and the noble metal chip.

In the production of the noble metal chip and intermediate member assembly, it is preferable to carry out the joining of the intermediate member and the noble metal chip by laser beam welding. The laser beam welding can concentrate heat more easily and make the melting depth larger, thus making it possible to prevent cracks or separation from being caused at the joint between the intermediate member and the noble metal chip more assuredly.

Further, the welding of the intermediate member and the electrode main body can be done by laser beam welding or by resistance welding. Particularly, when resistance welding is employed, there is no possibility of an excessively large compressive force at the joint between the intermediate member and the noble metal chip and there is no need to worry about occurrence of cracks or separation at the joint between them.

In either laser beam welding or resistance welding, it is desirable to apply to the intermediate member and the electrode main body an urging force that is larger than a predetermined value for holding them in position and in fitting contact with each other. In order that the urging force is applied to the intermediate member and the electrode main body without causing an excessively large force to act upon the joint between the intermediate member and the noble metal chip, the following steps are performed. Namely, in the step of placing, a plane of projection on which a projected area of joining surfaces of the intermediate member and the electrode main body becomes minimum is considered. In orthogonal projection of the intermediate member and the electrode main body on the plane of projection, a region at which projected regions of the intermediate member and the electrode main body overlap each other is defined as a first overlapping region, and a region at which projected regions of the intermediate member and the noble metal chip overlap each other is defined as a second overlapping region. In the first overlapping region is formed a non-overlapping region that does not belong to the second overlapping region. Then, an urging force for urging the intermediate member and the electrode main body to fittingly contact with each other is applied to portions of the intermediate member and the electrode main body that correspond to the non-overlapping region of the first overlapping region, and under this condition the intermediate member and the electrode main body are welded together. By applying the urging force only to the non-overlapping region, the urging force is not applied to the joining surfaces of the intermediate member and the noble metal chip.

Further, in the step of placing, the electrode main body can have a through hole or bottomed hole that has an open end at the side facing the center electrode, and the noble metal chip and intermediate member assembly can be inserted through the open end into the through hole or bottomed hole in a way as to allow the noble metal chip and intermediate member assembly to project from the open end. By inserting the noble metal chip and intermediate member assembly into the through hole or bottomed hole of the electrode main body, relative movement of the noble metal chip and intermediate member assembly and the electrode main body in the directing crossing the insertion direction thereof can be restricted, thus making it possible to attain the welding of the electrode main body and the intermediate member assuredly and efficiently.

In this instance, by pushing the intermediate member in the insertion direction by means of a pushing member, an urging force can be produced. By actively pushing the intermediate member against the electrode main body by using the pushing member, relative movement of the electrode main body and the intermediate member can be restricted assuredly even if the through hole or bottomed hole is larger in diameter than the intermediate member. In this instance, by using the pushing member as a welding electrode and by performing the welding by resistance welding that is performed at the joining portions of the intermediate member and the electrode main body that correspond to the non-overlapping region, the welding step can be carried out easily and assuredly.

The noble metal chip can be made of an Ir alloy. As described before, the noble metal chip of an Ir system alloy has a high melting point so that cracks or separation at the joint is liable to be caused when the joining of the noble metal chip is performed by the conventional resistance welding. However, by the present invention, an excessively large compressive force does not act upon the joining surfaces of the noble metal chip and the intermediate member so that a defect of cracks or separation is hard to be caused, notwithstanding the Ir alloy is used as a material for forming the noble metal chip. In this instance, the more effective result can be obtained when the noble metal chip made of an Ir alloy and the intermediate member are joined by laser beam welding that can attain a larger melting depth and a highly reliable joining.

Further, by forming the intermediate member from a metal having a coefficient of linear expansion that is intermediate between those of the metals forming the noble metal chip and the electrode main body, a bad influence caused by the difference in the coefficient of linear expansion can be reduced as compared with the case where the noble metal chip is directly joined to the electrode main body, thus making it possible to prevent cracks or separation from being caused at the joint between the noble metal chip and the intermediate member more effectively.

DESCRIPTION OF THE PREFERRED EMBODIMENTS

Figure 1:
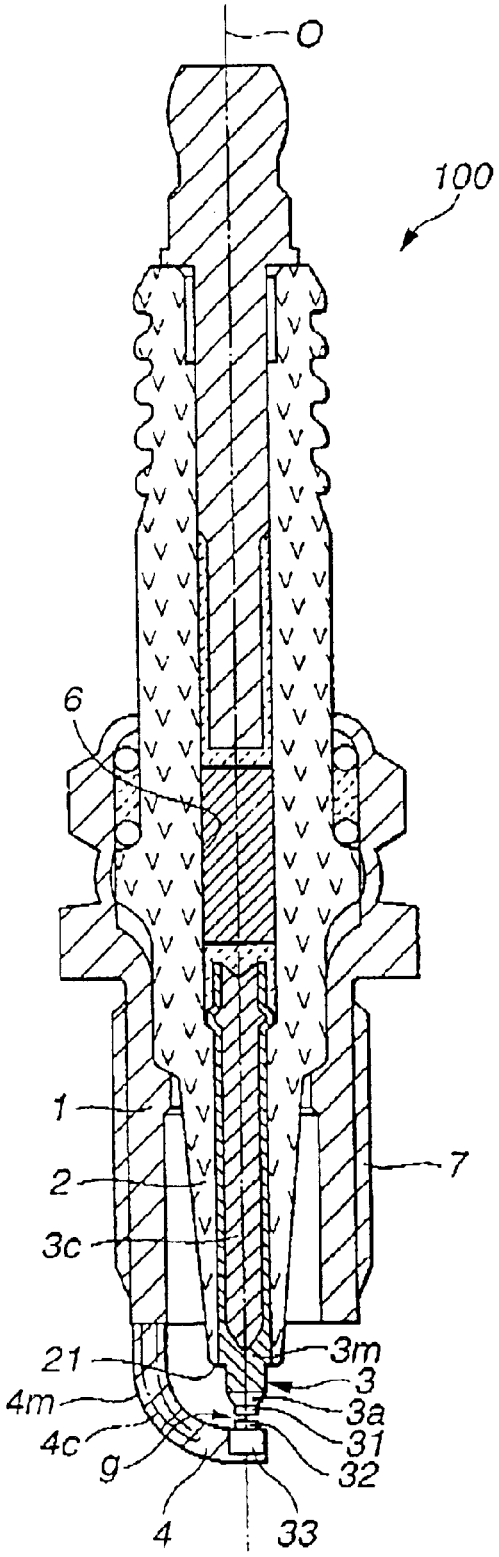
FIG. 1 is a longitudinal sectional view of a spark plug that is made by a method according to an embodiment of the present invention.

Referring first to FIG. 1, a spark plug is generally indicated by 100 and includes a cylindrical metal shell 1, an insulator 2 fitted in the metallic shell 1 and having an end portion protruding from the metallic shell 1, a center electrode 3 disposed inside the insulator 2 and having a leading end portion protruding from the insulator 2, and a ground electrode 4 welded or otherwise secured at one end to the metallic shell 1 and bent so as to have the other end portion facing the leading end portion (i.e., end surface) of the center electrode 3. The ground electrode 4 includes an electrode main body 4*m* and a noble metal chip 32 joined to the electrode main body 4*m* by interposing therebetween an intermediate member 33. The noble metal chip 32 faces the center electrode 3 so as to form therebetween a spark discharge gap g. The center electrode 3 has a main body 3*m* and a noble metal chip 31 welded to an end of the main body 3*m*. The noble metal chips 32, 31 are made of a noble metal alloy containing Ir as a major component (more than 50% by weight) and at least one accessory noble metal element selected from the group consisting of Pt, Rh, Ru and Re by 3 to 50% by weight in total.

The insulator 2 is formed from a sintered body of ceramic such as alumina or aluminum nitride and has a hole 6 in which the center electrode 3 is fitted. Further, the metallic shell 1 is tubular and made of metal such as low-carbon steel. The metallic shell 1 constitutes a housing of the spark plug 100 and has on the outer surface thereof a threaded portion 7 used for attaching the spark plug 100 to an engine block (not shown).

The ground electrode 4 and center electrode 3 have electrode main bodies 4*m*, 3*m*, respectively, and at least the surface layer portions of the electrode main bodies 4*m*, 3*m* are made of a Ni alloy. Herein, the materials forming at least the surface layer portions of the electrode main bodies 4*m*, 3*m* are referred to as electrode base materials, i.e., the materials of the electrode main bodies 4*m*, 3*m* are herein used to indicate the electrode base materials. An example of a concrete material of the electrode main bodies 4*m*, 3*m* is Inconel 600 (trademark and containing 76 wt % of Ni, 15.5 wt % of Cr, 8 wt % of Fe and the remainder of a small amount of additive elements or impurities), or Inconel 601 (trademark and contains 60.5% by weight of Ni, 23% by weight of Cr, 14% by weight of Fe and the remainder being a small amount of additional elements or impurities). In the meantime, in either of the ground electrode 4 and center electrode 3 are embedded heat transmission accelerating portions 4*c*, 3*c* made of Cu or Cu alloy.

Further, an intermediate member 33 provided to the ground electrode 4 is made of a metal having a coefficient of linear expansion that is intermediate between those of the metals (electrode base materials) constituting the noble metal chip 32 and the electrode main body 4*m*, respectively. Concretely, an Ir—Ni alloy or Ir—Ni—Rh alloy can be employed. For example, if the noble metal chip 32 is made of a metal containing 97% or less by weight of Ir and 3% or more of at least one element selected from the group consisting of Pt, Rh, Ru and Re, the intermediate member 33 can be made of a metal containing 30% or more by weight in total of Ir and Rh and 20% or more by weight in total of Rh and Ni. In the meantime, it is more desirable that the intermediate member 33 contains Ni as an indispensable component since the electrode main body 4*m* is made of an electrode base metal containing Ni as a major component so that the difference in the coefficient of linear expansion and the melting point between therebetween can be made smaller.

Figure 2:
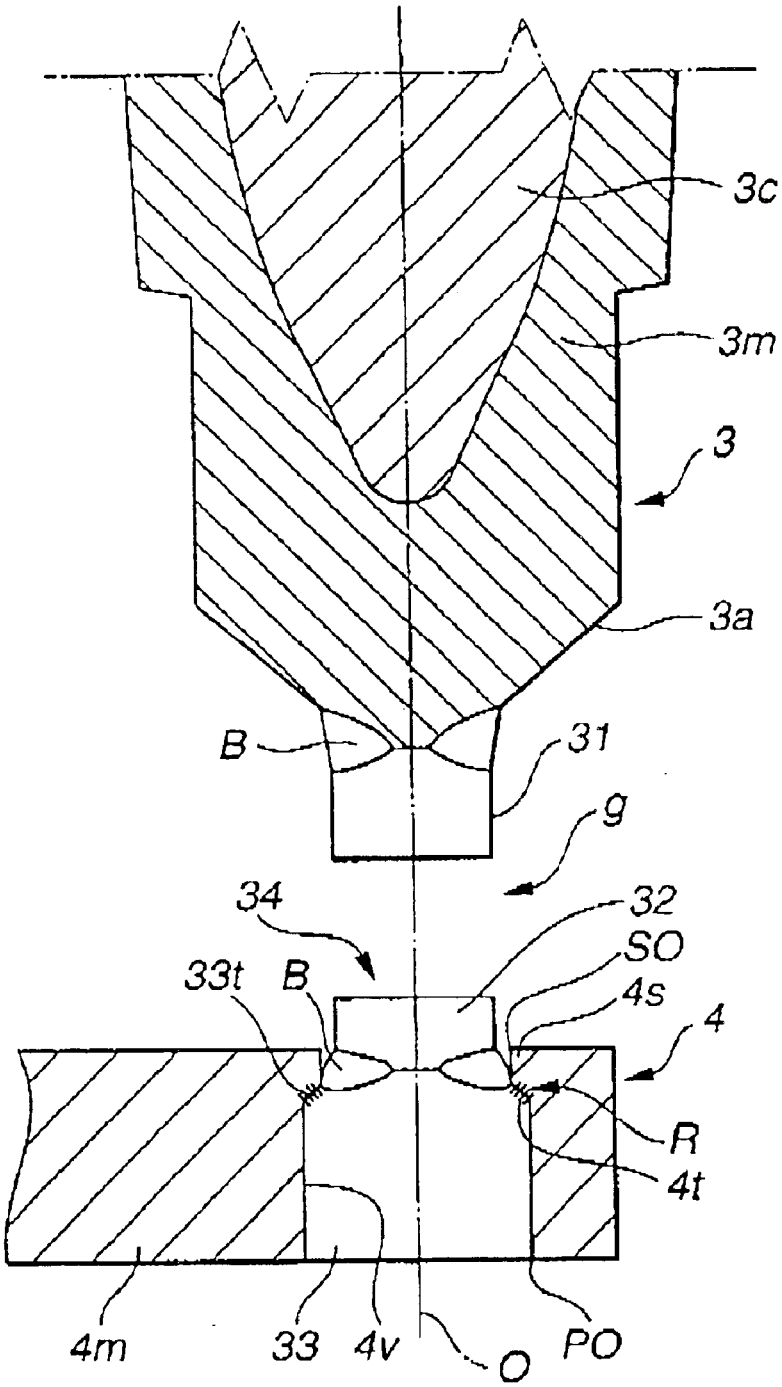
FIG. 2 is an enlarged sectional view of an important portion of the spark plug of FIG. 1.

As shown in FIG. 2, the leading end portion 3*a* of the center electrode 3 is tapered so as to reduce in cross section toward a leading end and has a flat leading end surface. On the flat leading end surface is placed the noble metal chip 31. The noble metal chip 31 is joined to the leading end portion 3*a* of the center electrode 3 by forming a welded portion B along the peripheries of the joint by laser beam welding, electron beam welding, resistance welding, etc.

The electrode main body 4*m* of the ground electrode 4 is formed with a through hole 4*v* having open ends at the side surfaces. Into the through hole 4*v* is inserted the intermediate member 33. The intermediate member 33 is tapered at the leading end side so as to reduce in the cross sectional area and has a leading end surface on which the noble metal chip 32 is placed. The noble metal chip 32 is joined to the intermediate member 33 by an annular, circumferential laser beam welded portion B. At the side of an open end from which the noble metal chip 32 protrudes so as to be exposed to the outside, i.e., at the side where a second open end SO of the through hole 4*v* is located, the inner circumferential surface of the through hole 4*v* has an annular, radially inward protrusion 4*s* that causes the second open end SO to reduce in the cross sectional area. The intermediate member 33 is engaged at the tapered surface 33*t* with the tapered surface 4*t* formed at the protrusion 4*s* and is thereby prevented from being slipped off or separated from the ground electrode main body 4*m* and is joined to the ground electrode main body 4*m* by a welded portion R formed at the joint between the taper surface 33*t* and taper surface 4*t* by means of resistance welding.

Referring to FIGS. 3A–3B and 4A–4B, the method of making the above-described spark plug 100 will be described. The method basically consists of the following three steps.

(1) The intermediate member 33 and the noble metal chip 32 are joined together to form a noble metal chip and intermediate member assembly 34 prior to being joined to the electrode main body 4*m* (step of joining).

(2) The noble metal chip and intermediate member assembly 34 is placed on the electrode main body 4*m* in a way as to allow the intermediate member 34 to contact the electrode main body 4*m* (step of placing).

(3) The electrode main body 4*m* and the noble metal chip and intermediate member assembly 34 are welded together under the condition where they are prevented from movement relative to each other without applying an urging force to the joint between the intermediate member 33 and the noble metal chip 32 by using another member (step of welding).

Figure 3A:
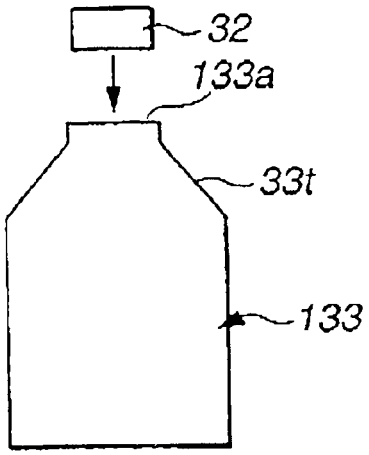
FIGS. 3A to 3C are view for illustrating steps in the method of the present invention.
Figure 3B:
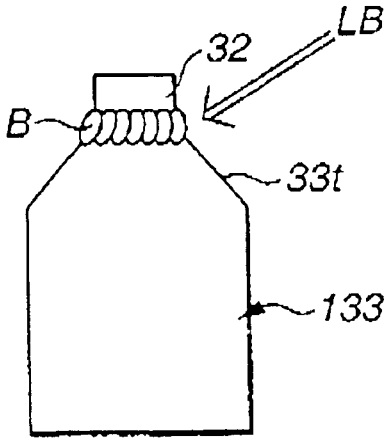
Figure 3C:
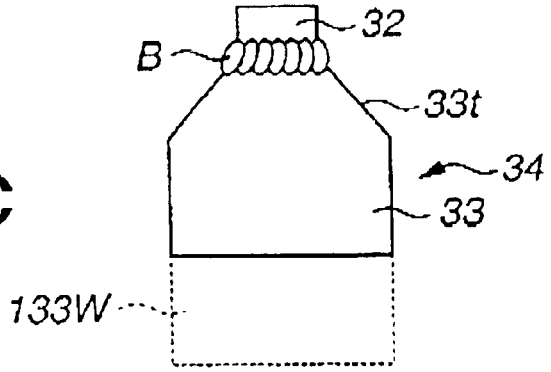

Firstly, as shown in step 1 of FIG. 3A, a stock or work 133 for the intermediate member 33 is formed with a flat leading end surface 133*a* and a tapered surface 33*t* by cutting or header, and the noble metal chip 32 in the form of a circular disk is placed on the leading end surface 133*a* of the work 133 for the intermediate member 33. Then, as shown in step 2 of FIG. 3B, a laser beam LB is applied to the work 133 and the noble metal chip 32 along the outer circumferential peripheries of the joining surfaces thereof, thereby forming an annular welded portion B extending between the noble metal chip 32 and the cylindrical work 133. In the meantime, if the work 133 has at the rear end portion thereof an unnecessary length portion 133W, the unnecessary length portion 133W can be cut off as shown in step 3 of FIG. 3C (of course, if there is not any unnecessary length portion, the step 3 can be dispensed with). In this manner, the work 133 is formed into the intermediate member 33 having the tapered surface 33*t* and joined with the noble metal chip 32 to constitute the noble metal chip and intermediate member assembly 34.

Figure 4A:
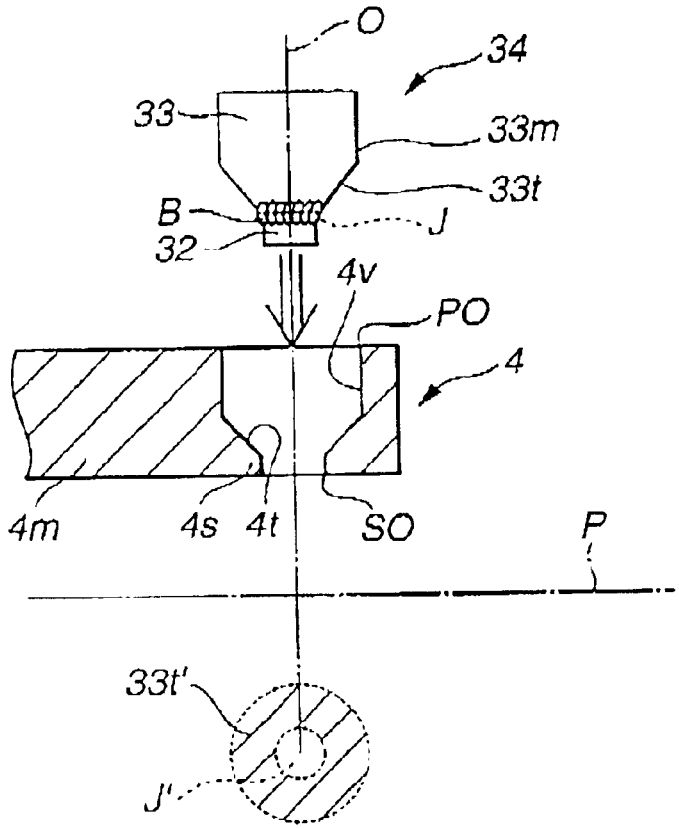
FIGS. 4A and 4B are views for illustrating steps in the method of the present invention that are continued from the steps of FIGS. 3A to 3C.

Then, as shown in step 4 of FIG. 4A, the electrode main body 4*m* is formed with the through hole 4*v* that has an open end at the side facing the center electrode 3. Then, in the above-described step of placing, the noble metal chip and intermediate member assembly 34 is inserted into the through hole 4*v* through the first open end PO so as to allow the noble metal chip 32 to protrude from the second open end SO. The tapered surface 4*t* formed in the inner surface of the through hole 4*v* serves as an electrode side engagement surface, and the tapered surface 33*t* formed in the intermediate member 33 of the intermediate assembly 34 serves as an intermediate member side engagement surface. By engagement of the tapered surface 4*t* and the tapered surface 33*t*, the intermediate member 34 is prevented from being slipped off in the insertion direction in which it is inserted into the through hole 4*v*.

By this, the intermediate member 33 and the electrode main body 4*m* are formed with joining surfaces that are placed one upon another, i.e., the tapered surface 4*t* of the through hole 4*v* and the tapered surface 33*t* of the intermediate member 33 are laminated or placed one upon another. Hereinafter, the joining surfaces are indicated by the reference character for the intermediate member 33 side, i.e., by 33*t*.

Herein, it is considered a plane P of projection that allows the projected area of the joining surfaces 33*t* of the intermediate member 33 and the electrode main body 4*m* to become minimum. In this embodiment, the plane P of projection is a plane that crosses the axis O of the intermediate member 33 at right angles. In orthogonal projection of the intermediate member 33 and the electrode main body 4*m* on the plane P of projection, the region at which the projected regions of the intermediate member 33 and the electrode main body 4*m* overlap each other is defined as a first overlapping region 33*t*', and the region at which the projected regions of the intermediate member 33 and the noble metal chip 32 overlap each other is defined as a second overlapping region J'. In this embodiment, the first overlapping region 33*t*' corresponds to the projected region of the tapered surface (joining surfaces) 33*t*, and the second overlapping region J' corresponds to the projected region of the joining interface J of the intermediate member 33 and the noble metal chip 32 (in FIG. 4A, the joining portions of the intermediate member 33 and the noble metal chip 32 are shown in the state into which they are put after welding). Accordingly, the first overlapping region 33*t*' forms in its entirety a non-overlapping region that does not belong to the second overlapping region J'.

Figure 4B:
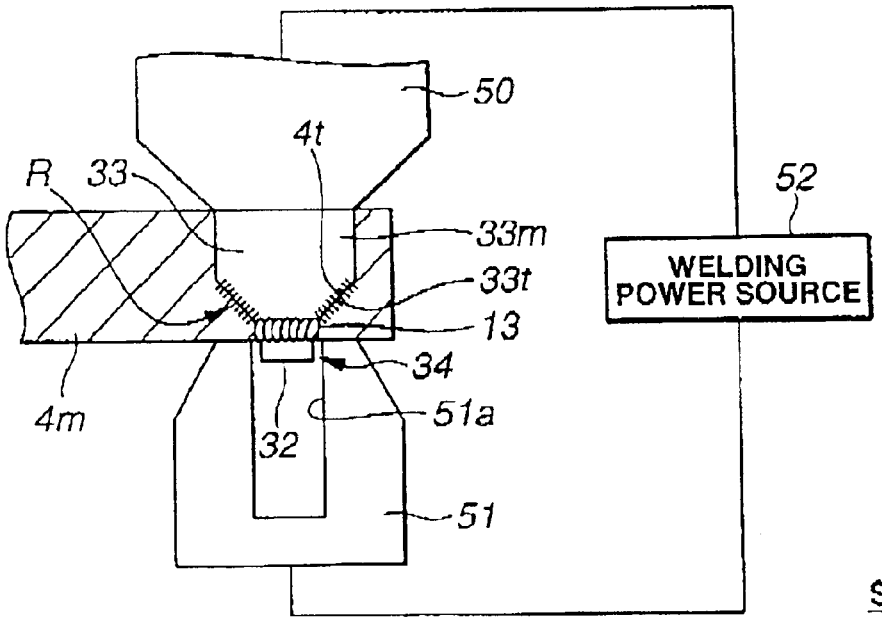

Step 5 of FIG. 4B illustrates the step of welding. Firstly, an urging force for urging the intermediate member 33 and the electrode main body 4*m* to fittingly contact with each other is applied to a portion of the intermediate member 33 that corresponds to the non-overlapping region of the first overlapping region, i.e., herein applied to the tapered surface (joining surface) 33*t*, and under this condition the intermediate member 33 and the electrode main body 4*m* are welded together. In this embodiment, all the joining surfaces 4*t*, 33*t* of the electrode main body 4*m* and the intermediate member 33 correspond to the non-overlapping region so that the urging force is inevitably applied only to the portions (joining surfaces 4*t*, 33*t*) of the intermediate member 33 and the electrode main body 4*m* that correspond to the non-overlapping region.

Further, when the intermediate member 33 is urged or pushed in the insertion direction by means of a pushing member 50, an urging force for urging the intermediate member 33 against the tapered surface 4*t* of the electrode main body 4*m* can be assuredly produced at the tapered surface 33*t* (non-overlapping region). In step 5, the pushing member 50 is used as a welding electrode and a resistance welding is performed at the tapered surface 33*t* that is a portion corresponding the non-overlapping region.

In the embodiment shown in FIGS. 4A and 4B, as shown in step 4 the noble metal chip and intermediate member assembly 34 is inserted through the first open end PO into the through hole 4*v* and disposed inside the same so that the noble metal chip 32 protrudes from the second open end SO. As shown in step 5, a support member 51 is brought into contact with a portion of the electrode main body 4*m* surrounding the second open end SO so as not to interfere with the noble metal chip 32. Concretely, by using an electrode having a depression 51*a* at a location corresponding to the noble metal chip 32 as the support member 51 and allowing the noble metal chip 32 to be received inside the depression 51*a*, the above-described interference is avoided. Under this condition, the intermediate member 33 positioned inside the first open end PO is pressed against the support member 51 by means of the electrode that constitutes the pushing member 50. By supplying, under this condition, a welding current 52 between the pressing member 50 and the support member 51, the resistance welded portion R can be formed at the tapered surface 33*t* (non-overlapping region).

Figure 5:
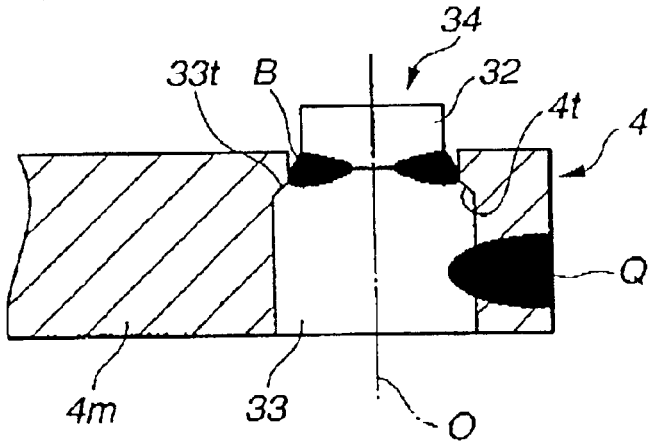
FIG. 5 is a view for illustrating a modification of the method of FIGS. 1 to 4A and 4B.
Figure 6:
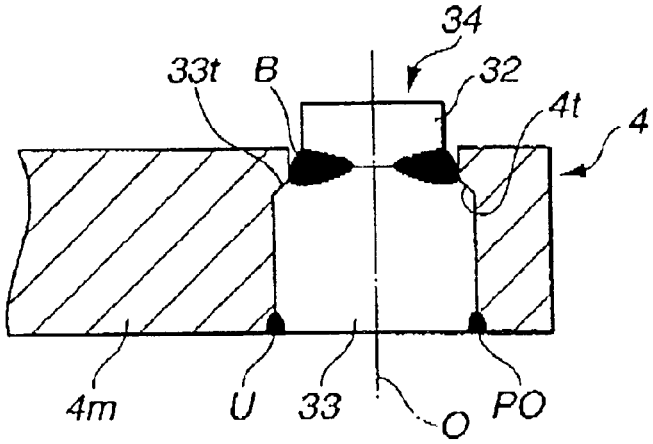
FIG. 6 is a view for illustrating another modification of the method of FIGS. 1 to 4A and 4B.
Figure 7:
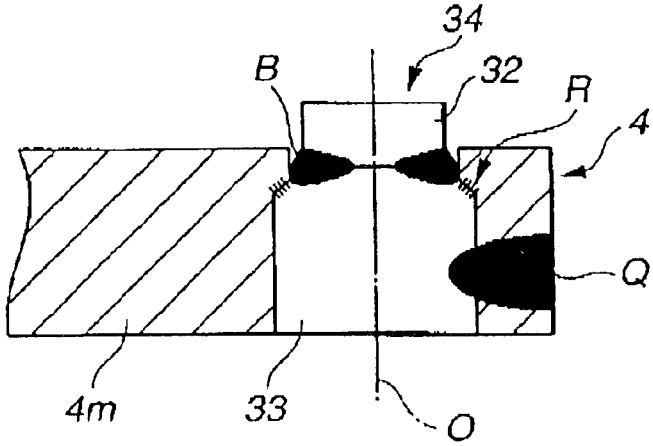
FIG. 7 is a view for illustrating a further modification of the method of FIGS. 1 to 4A and 4B.

In the meantime, in FIGS. 4A and 4B, the electrode main body 4*m* is disposed so as to allow the first open end PO to be positioned in a higher place. Accordingly, when the noble metal chip and intermediate member assembly 34 is inserted into the through hole 4*v*, the tapered surface 33*t* (non-overlapping region) of the intermediate member 33 and the tapered surface 4*t* of the through hole 4*v* are brought into contact with each other by the gravity acting on the intermediate member 33, thus causing the intermediate member 33 to be urged against the tapered surface 4*t* by the gravity. This urging force is not always sufficient for the resistance welding. However, since the intermediate member 33 is inserted into the through hole 4*v*, movement of the intermediate member 33 and the electrode main body 4*m* in the direction crossing the insertion direction is restricted. Namely, relative movement of the joining surfaces (tapered surface: non-overlapping region) of the both can be restricted. Accordingly, by employing laser welding, the intermediate member 33 and the electrode main body 4*m* can be joined without any problem. FIG. 5 shows an example in which a laser beam welded portion Q is formed so as to extend from the leading end surface side of the electrode main body 4*m* to the intermediate member 33. Further, FIG. 6 shows an example in which an annular laser weld portion U is formed so as to extend between the electrode main body 4*m* and the intermediate member 33. Further, as shown in FIG. 7, both the laser beam welded portion Q and the resistance welded portion R can be provided.

Figure 8:
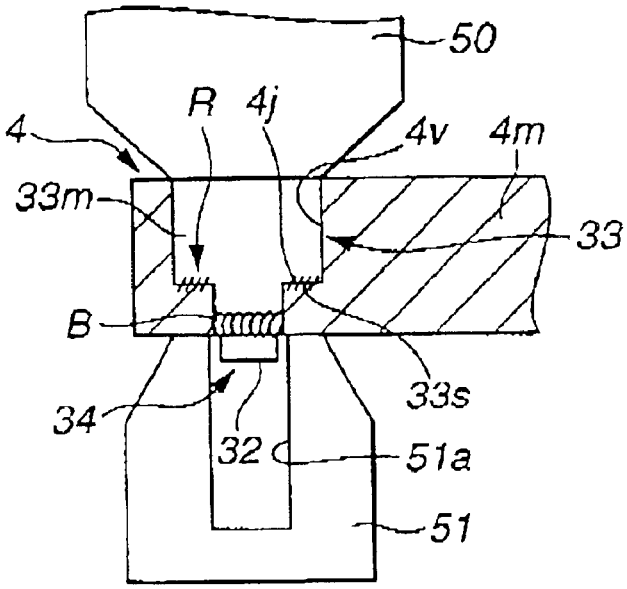
FIG. 8 is a view for illustrating a further modification of the method of FIGS. 1 to 4A and 4B.
Figure 9:
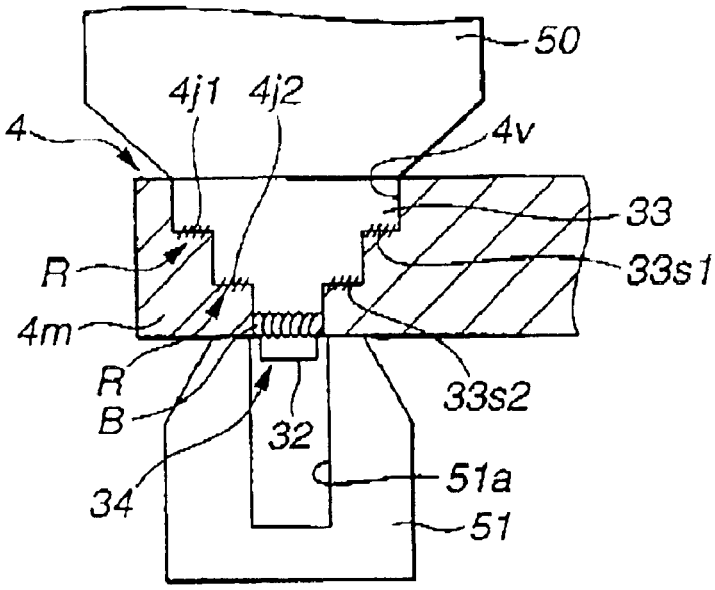
FIG. 9 is a view for illustrating a further modification of the method of FIGS. 1 to 4A and 4B.

In the meantime, it will do that the intermediate member side joining surface is not the tapered surface 33*t* but a stepped circumferential surface having a flat step surface 33*s* as shown in FIG. 8 or a plurality of flat step surfaces 33*s*1, 33*s*2 as shown in FIG. 9. The intermediate member 33 is thus reduced in the cross sectional area stepwise due to the provision of the step surface 33*s* (FIG. 8) or step surfaces 33*s*1, 33*s*2 (FIG. 9). Further, the inner circumferential surface of the through hole 4*v* is stepped so as to have a step surface 4*j* (FIG. 8) engaged with the step surface 33*s* or step surfaces 4*j*1, 4*j*2 (FIG. 9) engaged with the step surfaces 33*s*1, 33*s*2. At the step surface 33*s* (FIG. 8) or at the step surfaces 33*s*1, 33*s*2 (FIG. 9) can be formed a resistance welded portion or portions R, respectively.

Hereinafter, a method of making a spark plug according to another embodiment of the present invention will be described with reference to FIGS. 10A to 10D.

Figure 10A:
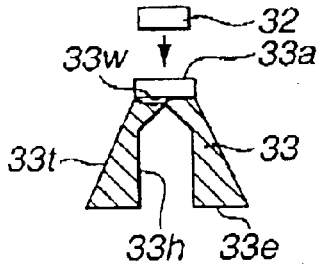
FIGS. 10A to 10D are views for illustrating a method according to another embodiment of the present invention.
Figure 10B:
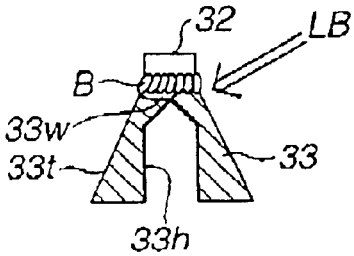
Figure 10C:
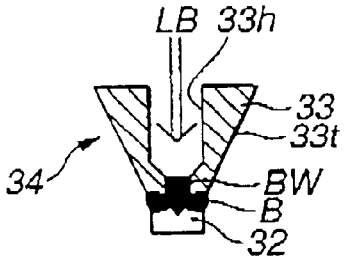

In FIG. 10A, the leading end surface (first end surface) 33*a* of the intermediate member 33 is a joining surface on which the noble metal chip 32 is placed. The intermediate member 33 is formed with a depression or bottomed hole 33*h* that has an open end at the second end surface 33*e* to which the noble metal chip 32 is not joined (step 1). By the bottomed hole 33*h*, the intermediate member 33 is formed with a thin-walled portion 33*w* adjacent the leading end surface 33*a*. By applying laser beam welding to the bottom of the bottomed hole 33*h* (i.e., irradiating laser beam to the bottom of the bottomed surface 33*h*), the intermediate member 33 and the noble metal chip 32 can be welded together. Such welding has an advantage that an improved joining strength can be attained even in case a sufficient welding depth cannot be obtained by the laser beam welding applied to the side surface of the intermediate member 33.

In this embodiment, a laser beam welded portion B is first formed so as to extend along the outer peripheries of the joining surfaces of the noble metal chip 32 and the intermediate member 33 (step 2). Further, the laser beam LB is irradiated toward the bottom of the bottomed surface 33*h* from the open end side of the same thereby forming another laser beam welded portion BW that penetrates through the thin-walled portion 33*w* into the noble metal chip 32 (step 3). In this connection, the step 2 and step 3 can be executed in the reverse order.

Figure 10D:
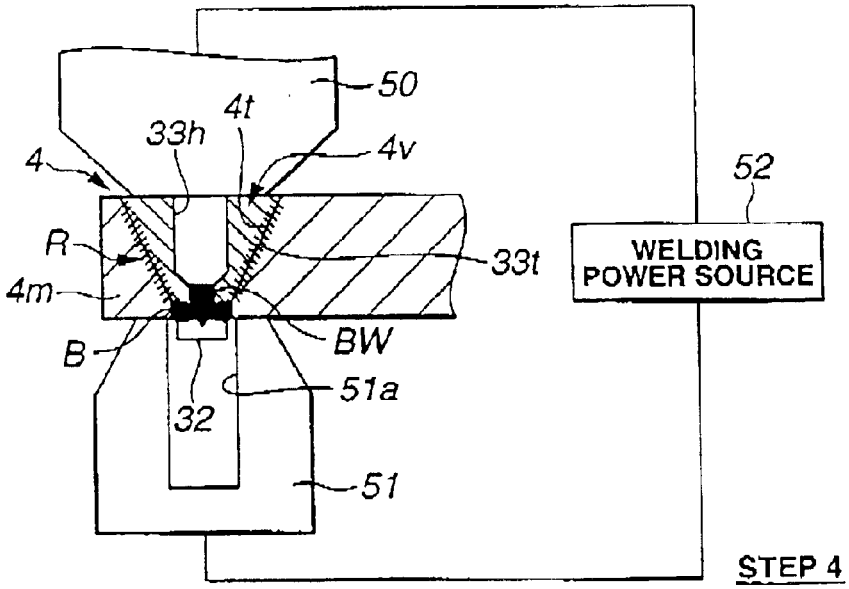
Figure 11:
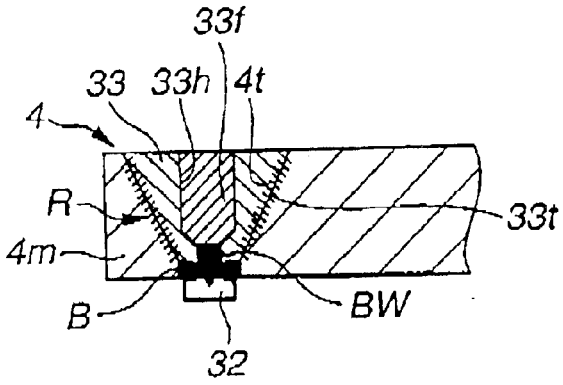
FIG. 11 is a view for illustrating a modification of the method of FIGS. 10A to 10D.

Then, as shown in step 4 of FIG. 10D, the step of placing and the step of welding are substantially the same as those shown in FIGS. 4A and 4B so that only the difference therebetween will be described. The intermediate member 33 is formed into a frustoconical shape and has an outer circumferential surface 33*t* that is tapered nearly in its entirety. The through hole 4*v* of the electrode main body 4*m* has an inner circumferential surface 4*t* that is tapered correspondingly to the tapered outer circumferential surface 33*t* of the intermediate member 33. The tapered inner and outer circumferential surfaces 4*t* and 33*t* are joined together by a resistance welded portion R. In the meantime, as shown in FIG. 11, the bottomed hole 33*h* used for forming the laser beam welded portion BW can be filled with a metallic filler 33*f*. This filling can be attained by, for example, build up welding.

Figure 12A:
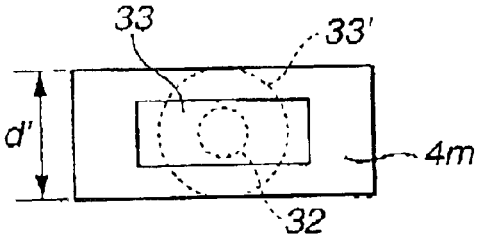
FIGS. 12A to 12C are views for illustrating a modification of the method of FIGS. 1 to 4A and 4B.
Figure 12B:
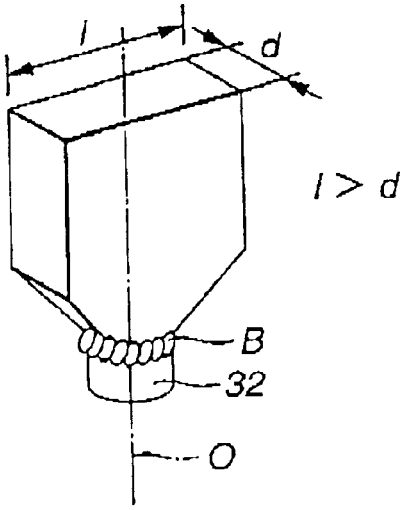
Figure 12C:
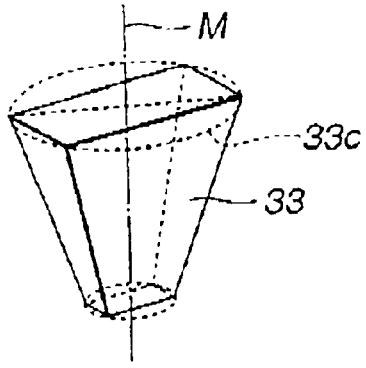

Further, the cross sectional shape of the intermediate member that is taken along the plane perpendicular to the joining direction O of the intermediate member 33 is not limited to a circular shape but can be various shapes such as a rectangular shape. For example, as shown in FIGS. 12A to 12C, if an intermediate member 33' indicated by a one-dot chain line and having a circular cross section is employed when it is desired to make larger the cross sectional area of the noble metal chip 32, there may occur such a case in which the width d' of the electrode main body 4*m* is insufficient or too small and it becomes difficult for the intermediate member 33' to be successfully embedded in the electrode main body 4*m*. In this instance, it is effective to employ an intermediate member that is not of a circular cross section but of a flat cross section such as a rectangular cross section as shown in FIG. 12B. Namely, assuming that the intermediate member 33 has a cross section of a short side d and a long side 1, it will do to embed the intermediate member 33 in the electrode main body 4*m* in such a manner that the direction in which the short side d is elongated coincides with the width d' direction of the electrode main body 4*m*. In the meantime, as shown in FIG. 12C, the intermediate member 33 having such a flat shape can be produced by pressing a frustoconical work 33*c* from the diametrically opposite sides of the center axis M or by reducing the thickness by machining such as grinding.

Figure 13A:
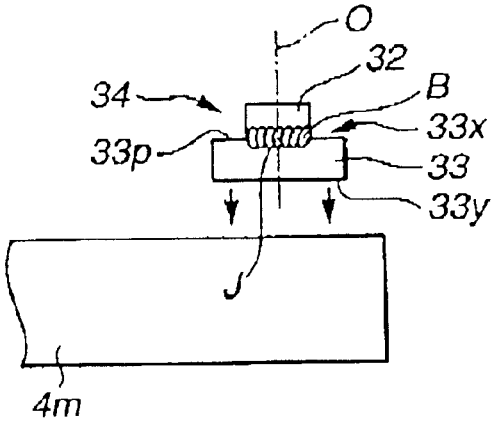
FIGS. 13A and 13B are views for illustrating a method according to a further embodiment of the present invention.
Figure 13B:
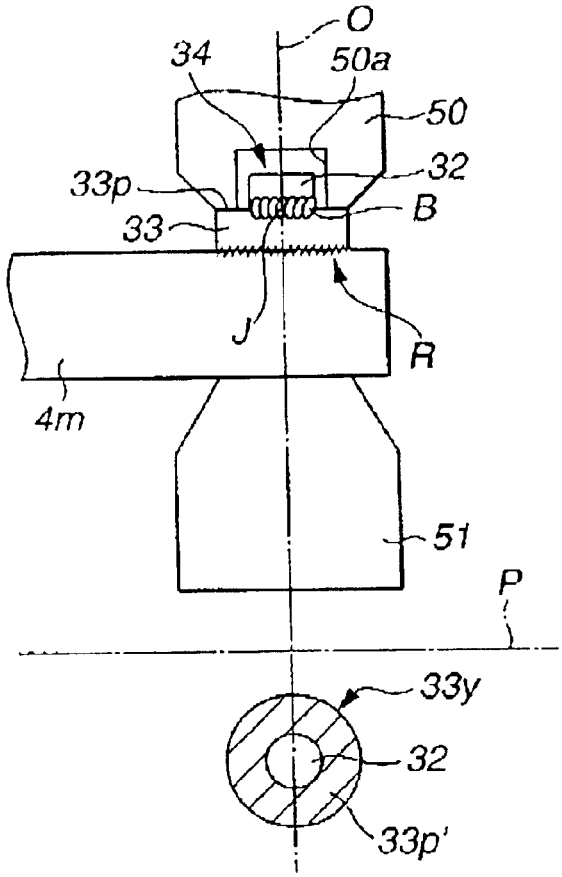

FIGS. 13A and 13B show a further embodiment. As shown in FIG. 13A, the intermediate member 33 has a first end surface 33*x* and a second end surface 33*y* that are opposed in the joining direction O. The noble metal chip 32 is joined to the first end surface 33*x*. The intermediate member 33 is placed on the electrode main body 4*m* in a way as to bring the second end surface 33*y* into contact with the electrode main body 4*m*. The joining surface J of the noble metal chip 32 is formed so as to be smaller in the area than the first end surface 33*x*. As shown in FIG. 13B, the intermediate member 33 is pushed at a surface region 33*p* that is not provided with the noble metal chip 32 against the electrode main body 4*m* by means of the pushing member 50. In this method, by bringing the pushing member 50 into contact with the surface portion 33*p* that is not provided with the noble metal chip 32, the intermediate member 33 can be pushed against the electrode main body 4*m* without pushing the noble metal chip 32, thus contributing to preventing a crack or cracks from being caused at the joint between the noble metal chip 32 and the intermediate member 33 and preventing the same from being separated from each other. Considering based on the above-described plane P of projection, the entirety of the second end surface 33*y* of the intermediate member 33 corresponds to the first overlapping region and the joining surface J of the noble metal chip 32 that corresponds to the second overlapping region is included completely within the second end surface 33*y*. Accordingly, the non-overlapping region is formed by the projected region 33*p*' of the surface portion 33*p* of the second end surface 33*y* so that the urging force is applied by the pushing member 50 to the portion of the intermediate member 33 that correspond to the non-overlapping region consisting of the projected region 33*p*'.

Figure 14:
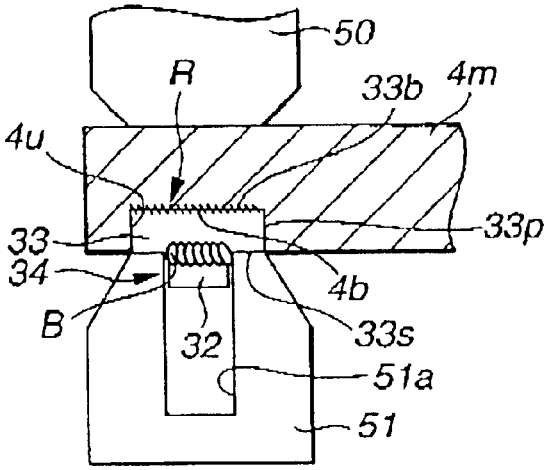
FIG. 14 is a view for illustrating a method according to a further embodiment of the present invention.

In this embodiment, the pushing member 50 is an electrode for resistance welding and formed with the depression 50*a* at a position corresponding to the noble metal chip 32 so as to apply a pushing force to the surface portion 33*p* corresponding to the non-overlapping region. Another support member 51 that serves as an electrode is disposed on the opposite side of the electrode main body 4*m*. By supporting the electrode main body 4*m* and the intermediate member 33 compressively and supplying current to flow therethrough, the resistance welded portion R can be formed. In the meantime, as shown in FIG. 14, the intermediate member 33 can be disposed within a bottomed hole 4*u* that has an open end at one side of the electrode main body 4*m*. By this, it becomes possible to prevent the intermediate main body 33 and the electrode main body 4*m* from being moved out of position efficiently.

Figure 15A:
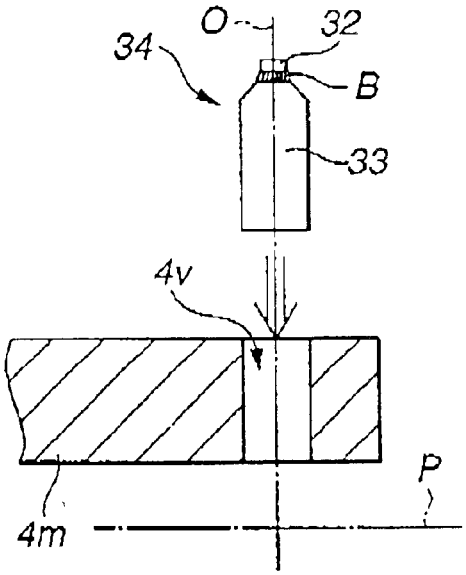
FIGS. 15A and 15B are views for illustrating a method according to a further embodiment of the present invention.
Figure 15B:
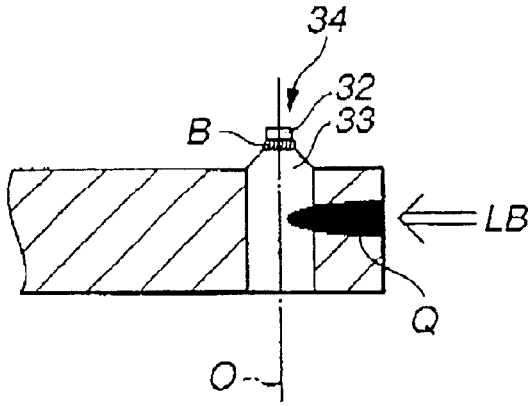

In all the embodiments in which the through hole 4*v* or bottomed hole 4*u* is formed so as to dispose therewithin the intermediate member 33, the fitting between the intermediate member 33 and the through hole 4*v* or bottomed hole 4*u* can be loose fit. However, the fitting can be interference fit. By doing so, an advantage of making higher the flexibility in carrying out the steps can be attained because slipping off of the noble metal chip and intermediate member assembly 34 from the electrode main body 4*m* is prevented by interference fit even if the side of the electrode main body 4*m* that is not provided with any means for preventing slipping off of the noble metal chip and intermediate member assembly 34 from the electrode main body 4*m* is turned downward. Further, as shown in FIGS. 15A and 15B, without providing the electrode side engagement surface and the intermediate member side engagement surface to the inner circumferential surface of the through hole 4*v* and the outer circumferential surface of the intermediate member 33, respectively, the inner circumferential surface of the through hole 4*v* and the outer circumferential surface of the intermediate member 33 can be used as the joining surfaces and fittingly joined together by using the fitting force of the interference fit as the urging force. In FIGS. 15A and 15B, the intermediate member 33 and the electrode main body 4*m* are joined together by a laser beam welded portion Q similar to that of FIG. 5. In this instance, the through hole 4*v* can be replaced by a bottomed hole 4*u* as shown in FIGS. 16A and 16B.

Figure 16A:
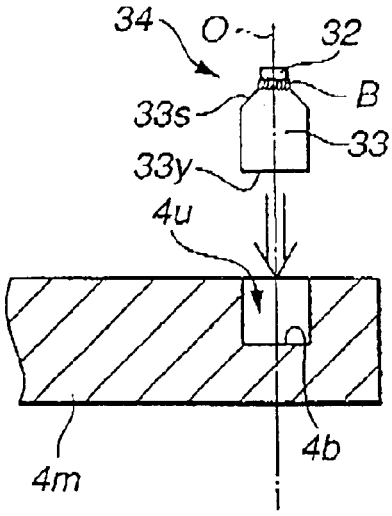
FIGS. 16A and 16B are views for illustrating a method according to a further embodiment of the present invention.
Figure 16B:
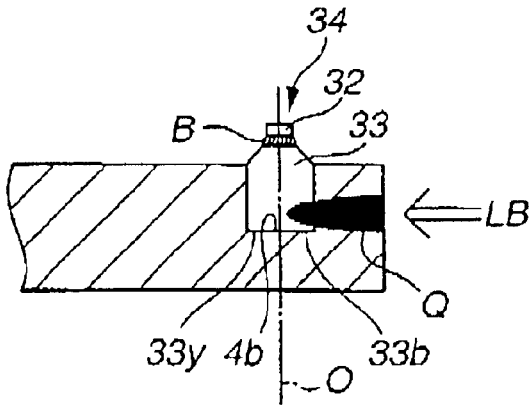

In the meantime, in case the bottomed hole 4*u* shown in FIGS. 16A and 16B is used, loose fit can be used in place of interference fit. Namely, the noble metal chip and intermediate member assembly 34 is loose fitted in the bottomed hole 4*u* under the condition where the electrode main body 4*m* is held so as to allow the open end of the bottomed hole 4*u* to be held on the upper side, while bringing the second end surface 33*y* of the intermediate member 33 into contact with the bottom 4*b* of the bottomed hole 4*u*. By this method, an urging force is not applied to the non-overlapping region formed in the second end surface 33*y*. However, as shown in FIG. 16B, a laser beam welded portion Q similar to that of FIG. 15B can be formed by holding the intermediate member 33 in the state as shown. Namely, without applying an urging force to the intermediate member 33 and the noble metal chip 32 by means of another member and in the joining direction O, the electrode main body 4*m* and the intermediate member 33 can be welded together while preventing relative movement thereof.

EXAMPLE

In order to confirm the effect of the method according to the present invention, the following experiments were made. Ir-40Rh alloy (i.e., an alloy containing Ir as a major component and 40 wt % of Rh) was prepared as a material for forming the noble metal chip 32 on the ground electrode 4 side. A work or ingot of this alloy was hot-forged at 1500° C., then hot-rolled or hot-swaged at 1300° C. and further hot-drawn at 1200° C. to give an alloy wire of 1.4 mm in diameter. The wire was cut and thereby formed into a chip in the form of a circular disk of the diameter of 1.4 mm and of the thickness of 0.6 mm. Further, the intermediate member 33 was made of Ir-40Ni alloy (i.e., alloy containing Ir as a major component and 40 wt % of Ni) and formed into a circular disk of the diameter of 2.2 mm and the thickness of 0.6 mm. The both were joined together by laser beam welding and thereby formed into the noble metal chip and intermediate member assembly 34 shown in FIG. 13A. The noble metal chip and intermediate member assembly 34 was placed on the side surface (of the width of 2.8 mm) of the electrode main body made of Inconel 600 (trademark). Then, resistance welding was carried out by the method shown in FIG. 13B, i.e., under supply of current of 12A and by applying a force of 380N to only the surface portion of the intermediate member 33 that is not provided with the chip 32, thereby forming the ground electrode of this example. In the meantime, for comparison, a ground electrode was produced by resistance welding while pushing the noble metal chip 32 with an equal force. Then, by using the ground electrodes and the center electrodes, test samples of spark plugs of the type shown in FIG. 1 were produced (however, the spark gap were 0.4 mm).

The spark plugs were tested for the separation-resisting ability of the noble metal chip 32 in the following manner. Namely, the spark discharge gap side end of each spark plug was subjected to cyclic heating and cooling (i.e., heating up to 1000° C. for two minutes by using a burner and air cooling for one minute) and the separation-resisting ability was evaluated based on the number of heating and cooling cycles to which the spark plug was subjected before separation of the noble metal chip occurred. By the test results, it was confirmed that in the spark plug in which the ground electrode of the comparative example was used, separation of the noble metal chip 32 occurred after 1200 cycles and in contrast to this separation of the noble metal chip 32 was not caused in the spark plug in which the ground electrode of the example produced by the method of this invention even after 3000 cycles. It was thus confirmed that the spark plug made by the method of the present invention had a good durability.

The entire contents of Japanese Patent Application P2002-051291 (filed Feb. 27, 2002) are incorporated herein by reference.

Although the invention has been described above by reference to certain embodiments of the invention, the invention is not limited to the embodiments described above. Modifications and variations of the embodiment described above will occur to those skilled in the art, in light of the above teachings. The scope of the invention is defined with reference to the following claims.

What is claimed is:

1. A method of making a spark plug that includes a ground electrode having an electrode main body and a noble metal chip joined to the electrode main body by interposing therebetween an intermediate member, the noble metal chip being disposed so as to face a center electrode and define therebetween a spark discharge gap, the method comprising the steps of:

prior to joining the noble metal chip to the electrode main body, joining the intermediate member and the noble metal chip together and thereby forming a noble metal chip and intermediate member assembly;

placing the noble metal chip and intermediate member assembly on the electrode main body in a way as to allow the intermediate member to contact the electrode main body; and welding the electrode main body and the intermediate member of the noble metal chip and intermediate member assembly together while restricting relative movement of the electrode main body and the intermediate member of the noble metal chip and intermediate member assembly without applying an urging force to a joint between the intermediate member and the noble metal chip by using an another member.

2. A method according to claim 1, wherein the step of welding comprises laser beam welding the electrode main body and the intermediate member of the noble metal chip and intermediate member assembly together.

3. A method according to claim 1, wherein the step of welding comprises resistance welding the electrode main body and the intermediate member of the noble metal chip and intermediate member assembly.

4. A method according to claim 1, wherein the step of joining comprises laser beam welding the intermediate member and the noble metal chip together.

5. A method according to claim 1, wherein the step of placing comprises:

considering a plane of projection on which a projected area of joining surfaces of the intermediate member and the electrode main body becomes minimum; and in orthogonal projection of the intermediate member and the electrode main body on the plane of projection, defining a region at which projected regions of the intermediate member and the electrode main body overlap each other as a first overlapping region, defining a region at which projected regions of the intermediate member and the noble metal chip overlap each other as a second overlapping region, and defining a portion of the first overlapping region that does not belong to the second overlapping region as a non-overlapping region; and wherein the step of welding comprises:

applying an urging force for urging the intermediate member and the electrode main body to fittingly contact with each other to a portion of the intermediate member that corresponds to the non-overlapping region of the first overlapping region.

6. A method according to claim 5, wherein the step of placing comprises forming in the electrode main body one of a through hole and bottomed hole having an open end at a side facing the center electrode, and inserting the noble metal chip and intermediate member assembly into one of the through hole and the bottomed hole in a way as to allow the noble metal chip to project from the open end of one of the through hole and the bottomed hole.

7. A method according to claim 6, wherein the step of placing comprises forming in the electrode main body a through hole having at a side facing the center electrode a first open end and at a side opposite to the side facing the center electrode a second open end, and inserting the noble metal chip and intermediate member assembly into the through hole through the first open end so as to allow the noble metal chip to protrude from the second open end while allowing an electrode side engagement surface formed in an inner surface of the through hole and an intermediate member side engagement surface formed in the intermediate member to engage with each other and thereby preventing the intermediate member from being pulled off in an insertion direction in which the intermediate member is inserted into the through hole.

8. A method according to claim 7, wherein the step of placing comprises placing the noble metal chip and intermediate member assembly on the electrode main body in a way as to allow the intermediate member to be positioned above the electrode main body and allowing the intermediate member to be urged against the electrode main body by gravity and thereby applying the urging force to portions of the electrode main body and die intermediate member that correspond to the non-overlapping region.

9. A method according to claim 8, wherein the step of welding comprises laser beam welding the intermediate member of the noble metal chip and intermediate member assembly and the electrode main body.

10. A method according to claim 6, wherein the step of placing comprises force-fitting the intermediate member of the noble metal chip and intermediate member assembly in one of the through hole and the bottomed hole.

11. A method according to claim 5, wherein the step of welding comprises producing the urging force by pushing the intermediate member in the insertion direction by means of a pushing member.

12. A method according to claim 11, wherein in the step of welding comprises employing the pushing member as a welding electrode, and resistance welding portions of the electrode main body and the intermediate member that correspond to the non-overlapping region.

13. A method according to claim 5, wherein the step of placing comprises defining an end surface of the intermediate member to which the noble metal chip is joined as a first end surface and an end surface of the intermediate member opposite to the first end surface as a second end surface and placing the noble metal chip and intermediate member assembly on the electrode main body in away as to allow the second end surface of the intermediate member to contact the electrode main body, and wherein the step of welding comprises pushing a portion of the intermediate member corresponding to the non-overlapping region against the electrode main body by means of a pushing member.

14. A method according to claim 13, wherein the step of placing comprises disposing the intermediate member of the noble metal chip and intermediate member assembly in a bottomed hole that is formed in the electrode main body so as to have an open end at a side of the electrode main body.

15. A method according to claim 1, wherein the step of placing comprises forming in the electrode main body a bottomed hole, defining an end surface of the intermediate member to which the noble metal chip is joined as a first end surface and an end surface of the intermediate member opposite to the first end surface as a second end surface, and disposing the noble metal chip and intermediate member assembly in the bottomed hole in a way as to allow the second end surface to contact a bottom surface of the bottomed hole.

16. A method according to claim 1, further comprising, prior to the step of joining, defining an end surface of the intermediate member to which the noble metal chip is joined as a first end surface and an end surface of the intermediate member opposite to the first end surface as a second end surface, and forming in the intermediate member a bottomed hole having an open end at the second end surface, wherein the step of welding comprises laser beam welding applied to a bottom of the bottomed hole to weld the intermediate member and the noble metal chip together.

17. A method according to claim 1, wherein the noble metal chip is made of an Ir alloy.

18. A method according to claim 1, wherein the intermediate member is made of a metal having a coefficient of linear expansion that is intermediate between those of metals forming the noble metal chip and the electrode main body.

* * * * *